US005100486A

United States Patent [19]

Krikorian et al.

[11] Patent Number: 5,100,486

[45] Date of Patent: Mar. 31, 1992

[54] METHOD OF COATING METAL SURFACES TO FORM PROTECTIVE METAL COATING THEREON

[75] Inventors: Oscar H. Krikorian, Danville; Paul G. Curtis, Tracy, both of Calif.

[73] Assignee: The United States of America as represented by the United States Department of Energy, Washington, D.C.

[21] Appl. No.: 563,896

[22] Filed: Aug. 7, 1990

Related U.S. Application Data

[63] Continuation of Ser. No. 338,087, Apr. 14, 1989, abandoned.

[51] Int. Cl.[5] ..... C23C 20/02

[52] U.S. Cl. ..... 148/248; 427/383.9; 427/310; 148/273; 148/271; 148/281

[58] Field of Search ..... 148/273, 271, 281, 248; 427/383.9, 310

[56] References Cited

U.S. PATENT DOCUMENTS

| | | | |
|---|---|---|---|
| 2,889,238 | 6/1959 | Lang | 427/310 |
| 3,723,160 | 3/1973 | Tanaka | 427/310 |
| 3,748,170 | 7/1973 | Michsel | 427/310 |
| 3,765,953 | 10/1973 | Chevillon | 148/281 |
| 4,181.757 | 1/1980 | Youdelis | 427/310 |

FOREIGN PATENT DOCUMENTS

| | | | |
|---|---|---|---|
| 6008380 | 5/1971 | Japan | 427/310 |
| 1068177 | 4/1986 | Japan | 427/310 |

*Primary Examiner*—Sam Silverberg

*Attorney, Agent, or Firm*—Henry P. Sartorio; L. E. Carnahan; William R. Moser

[57] ABSTRACT

A process is disclosed for forming a protective metal coating on a metal surface using a flux consisting of an alkali metal fluoride, an alkaline earth metal fluoride, an alkali metal fluoaluminate, an alkali metal fluosilicate, and mixtures thereof. The flux, in particulate form, is mixed with particles of a metal coating material which may comprise aluminum, chromium, mixtures thereof, and alloys containing at least 50 wt. % aluminum and the particulate mixture is applied to the metal surface in a single step, followed by heating the coated metal surface to a temperature sufficient to cause the metal coating material to react with the metal surface to form a protective reaction product in the form of a metal coating bonded to the metal surface. The metal surface which reacts with the metal coating material to form the protective coating may comprise Fe, Co, Ni, Ti, V, Cr, Mn, Zr, Nb, Mo, Tc, Hf, Ta, W, Re and alloys thereof.

31 Claims, 1 Drawing Sheet

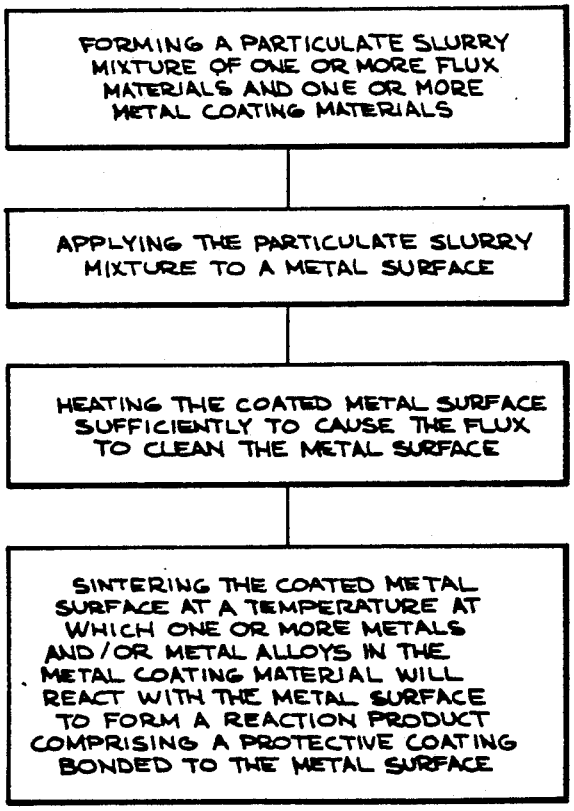

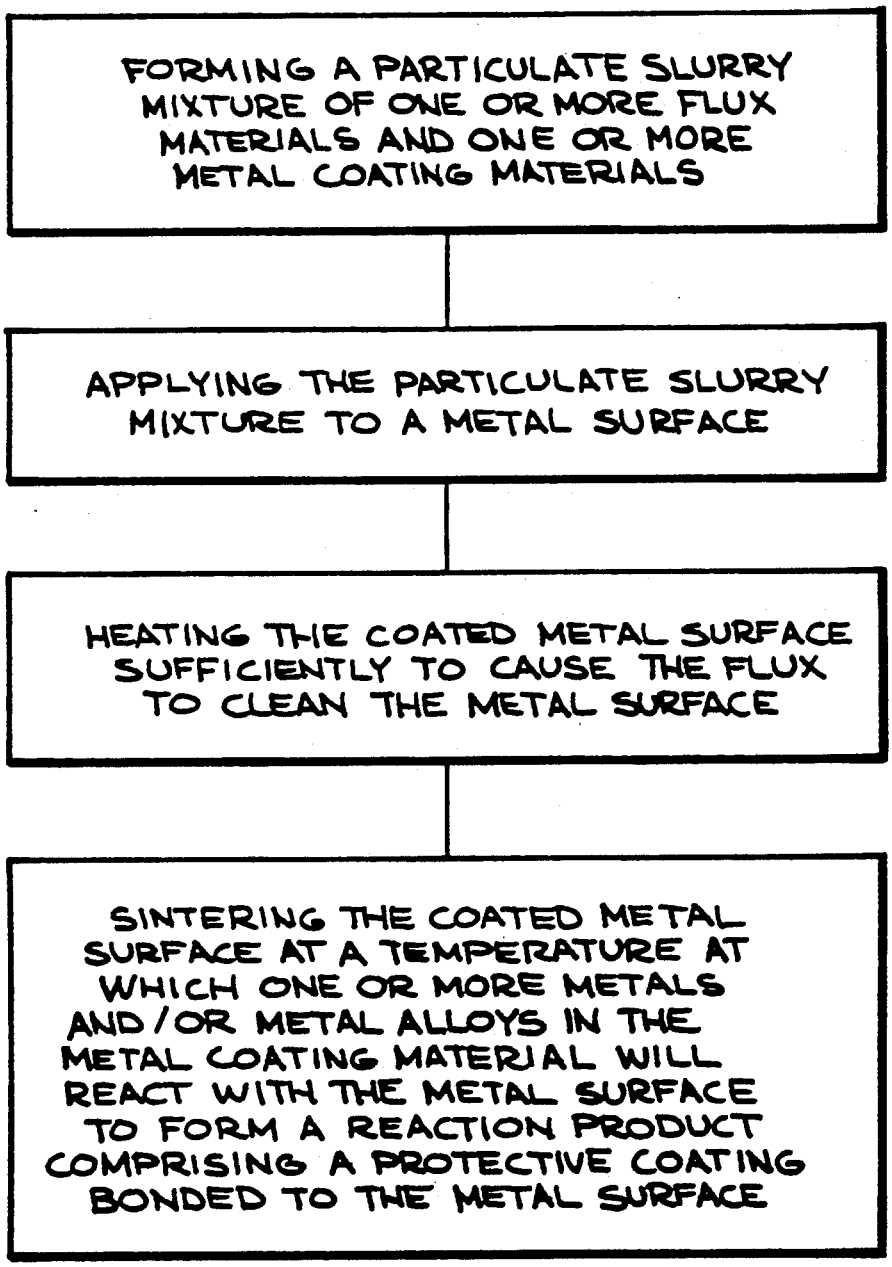
FORMING A PARTICULATE SLURRY MIXTURE OF ONE OR MORE FLUX MATERIALS AND ONE OR MORE METAL COATING MATERIALS
APPLYING THE PARTICULATE SLURRY MIXTURE TO A METAL SURFACE
HEATING THE COATED METAL SURFACE SUFFICIENTLY TO CAUSE THE FLUX TO CLEAN THE METAL SURFACE
SINTERING THE COATED METAL SURFACE AT A TEMPERATURE AT WHICH ONE OR MORE METALS AND/OR METAL ALLOYS IN THE METAL COATING MATERIAL WILL REACT WITH THE METAL SURFACE TO FORM A REACTION PRODUCT COMPRISING A PROTECTIVE COATING BONDED TO THE METAL SURFACE

METHOD OF COATING METAL SURFACES TO FORM PROTECTIVE METAL COATING THEREON

The invention described herein arose in the course of, or under, Contract No. W-7405-ENG-48 between the United States Department of Energy and the University of California.

This is a continuation of application Ser. No. 07/338,087 now abandoned, filed Apr. 14, 1989.

BACKGROUND OF THE INVENTION

This invention relates to the coating of a metal surface. More particularly, this invention relates to a method for coating a metal surface with a particulate mixture of a flux and a coating material comprising one or more metals or metal alloys in particulate form capable of reacting with the metal surface to form a protective coating thereon.

It is known to treat the surface of a ferrous metal with a flux to permit subsequent coating of the ferrous metal with an aluminum or aluminum alloy coating. For example, Owen U.S. Pat. No. 2,963,384 describes a method for coating a ferrous metal article with an aluminum metal coating which comprises immersing the ferrous metal in a molten flux bath containing NaCl, KCl, $Na_3AlF_6$, $K_3AlF_6$ and optionally $AlF_3$ and NaF, and then immediately transferring the fluxed ferrous metal object into a molten bath of aluminum, or aluminum alloy.

Teshima et al U.S. Pat. No. 3,027,269 discloses a process for coating a ferrous metal base with aluminum which comprises applying to the ferrous metal base an aqueous flux solution containing alkali metal halides and/or alkali metal hydroxide and/or alkali metal azide, drying the coated ferrous metal base at a temperature over 400° C., then heating the coated ferrous base in a reducing atmosphere at a temperature over 600° C., and then dipping the coated ferrous metal base into molten aluminum.

Shoemaker U.S. Pat. No. 3,860,438 discloses a process for coating a ferrous metal with an alloy containing from 25 to 70 wt. % aluminum and the balance zinc which comprises wetting the ferrous metal with an aqueous flux consisting essentially of potassium fluosilicate, potassium fluoride, zinc chloride, and hydrofluoric or a mixture of hydrofluoric and hydrochloric acid, drying the coated ferrous metal, and then immersing it in a molten bath of the aluminum zinc coating alloy.

It is also known to flux an aluminum body to facilitate brazing aluminum pieces together. For example, Chartet U.S. Pat. No. 3,667,111 describes a process for fluxing and brazing metal parts of aluminum or aluminum alloy which comprises forming a brazing flux such as alkali metal chlorides or fluorides, cryolite, aluminum fluoride, and zinc chloride and depositing the flux, e.g., by spraying, at a temperature of from 200°–400° C., on the portions to be brazed together, either by heating the flux or the parts. The parts are then heated to the brazing temperature.

Aoki U.S. Pat. No. 4,571,352 teaches a method for coating an aluminum metal body with an aluminum alloy brazing filler material and a flux by melting an aluminum alloy brazing filler material in a melting tank and then floating a flux over the molten metal consisting of a potassium fluoaluminate mixture of $K_3AlF_6$ and $KAlF_4$. An aluminum metal body is then dipped into the molten aluminum alloy brazing filler material through the flux layer and then withdrawn from the molten brazing metal layer through the flux layer to coat the aluminum body with both the flux and the aluminum alloy brazing filler material.

Fluxes have also been used to form a contact between a metal and a nonmetal such as graphite or a ceramic. For example, Anderson U.S. Pat. No. 3,119,171 teaches a method for making a low resistance contact of indium on a graphite body which comprises applying a cesium fluoride flux to the graphite body and then heating the graphite in contact with indium or an indium alloy to a temperature in excess of 1100° C.

Hodgkins U.S. Pat. No. 4,612,600 describes a process for sintering a base metal electrode such as a copper, manganese, cobalt, iron, or nickel electrode to a metal titanate ceramic such as barium titanate, calcium titanate, or strontium titanate using lithium fluoride or materials capable of forming lithium fluoride during sintering as a flux. The flux material and the ceramic materials are mixed together and formed into a sheet which is then coated with the base metal electrode. The coated sheet is then sintered at a temperature less than 950° C.

In the prior art described, various methods are disclosed for applying the flux to the surface to be coated. For example, the aforesaid Owen patent immerses the metal to be coated into a molten flux while the Aoki patent immerses the metal to be coated in a molten bath of brazing filler metal on which the flux floats as an upper layer. The aforementioned Chartet patent deposits the flux on the metal to be coated as a spray at an elevated temperature.

The Teshima et al, Anderson, and Shoemaker patents discussed above apply the flux to a metal surface from an aqueous solution. Kozono U.S. Pat. No. 4,774,106 sprays a liquid such as water to the parts to be joined together to form a liquid film on the surface of the parts and then applies a flux in particulate form onto the water film.

The Hodgkins patent mixes the flux with the ceramic powders comprising the ceramic substrate prior to sintering of the ceramic with the metal electrode coated thereon.

However, it would be desirable to form a protective coating on a metal surface, without the need for a separate step to independently apply a flux to the metal surface. This would be particularly advantageous when forming a protective metal coating on a surface of a metal which could otherwise form oxides on the surface thereof after being treated with an oxide-removing flux agent and prior to having a protective metal coating formed thereon in a separate step.

SUMMARY OF THE INVENTION

It is, therefore, an object of this invention to provide a method for forming a protective coating on a metal surface using a flux which is mixed with the metal coating material prior to applying the mixture of flux and coating material to the metal surface in a single step.

It is another object of this invention to provide a method for forming a protective coating on a metal surface which comprises forming a mixture of a flux and a metal coating material, applying the mixture to a metal surface in a single step, and then heating the coated metal surface to cause the flux to clean the metal surface and cause the metal coating material to react with the cleaned metal surface.

It is yet another object of this invention to provide a method for forming a protective coating on a metal surface which comprises forming a slurry mixture of a flux and one or more metal coating materials, applying the slurry mixture to a metal surface in a single step, and then heating the coated metal surface sufficiently to cause the flux to clean he metal surface and the metal coating material to react with the metal surface.

It is a further object of this invention to provide a method for forming a protective coating on a metal surface which comprises forming a slurry mixture of a flux and one or more metal coating materials in an organic carrier, applying the slurry mixture to a metal surface in a single step, heating the coated metal surface to cause the flux to clean the metal surface, and then heating the coated metal surface to cause the metal coating material to react with the metal surface.

It is a still further object of this invention to provide a method for forming a protective coating on a metal surface which comprises forming a slurry mixture comprising one or more flux agents and one or more metal coating materials capable of reacting with a metal surface at an elevated temperature to form a protective coating thereon, applying the slurry mixture to a metal surface in a single step, heating the coated metal surface to cause the one or more flux agents to clean the metal surface, and then heating the coated metal surface at a temperature sufficiently high to cause one or more metals in the metal coating material to react with the metal in the metal surface to form a reaction product which is bonded to the metal surface.

It is another object of this invention to provide a method for forming a protective coating on a metal surface which comprises: forming a slurry mixture comprising (1) one or more flux agents selected from the class consisting of zinc fluoride, cadmium fluoride, one or more alkali metal fluorides, one or more alkaline earth metal fluorides, one or more alkali metal fluoaluminates, one or more alkali metal fluosilicates, mixtures of same, and mixtures of chlorides, bromides, iodides, and fluorides of any one or more of the above metals wherein at least 10 wt. %, preferably at least 50 wt. %, of the mixtures comprises one or more fluoride salts with the balance comprising chloride, bromide, or iodide salts; and (2) a metal coating material comprising one or more metals, metal alloys, or mixtures of same capable of reacting with a metal surface at an elevated temperature to form a protective metal coating thereon; applying the slurry mixture to a metal surface in a single step; heating the coated metal surface to cause the one or more flux agents to clean the metal surface; and then heating the coated metal surface at a temperature sufficiently high to cause one or more metals in the metal coating material to react with the metal in the metal surface to form a reaction product which is bonded to the metal surface.

It is a further object of this invention to provide a method for forming a protective coating on a metal surface which comprises forming a mixture consisting essentially of one or more flux agents and a metal coating material comprising one or more metals selected from the class consisting of aluminum, chromium, and mixtures or alloys of same capable of reacting with a metal surface at an elevated temperature to form a protective coating thereon; applying the mixture to a metal surface in a single step, heating the coated metal surface sufficiently to cause the flux to clean the metal surface, and then heating the coated metal surface at a temperature sufficiently high to cause the one or more metals in the metal coating material to react with the metal in the metal surface to form a reaction product which is bonded to the metal surface.

It is yet another object of this invention to provide a method for forming a protective coating on a metal surface which comprises forming a mixture of one or more flux agents and a metal coating material comprising aluminum or an aluminum base alloy capable of reacting with a metal surface at an elevated temperature to form a protective coating thereon, applying the mixture to a metal surface in a single step, heating the coated metal surface sufficiently to cause the flux to clean the metal surface, and then heating the coated metal surface at a temperature sufficiently high to cause aluminum or aluminum base alloy to react with the metal in the metal surface to form a reaction product thereon which is bonded to the metal surface.

It is yet a further object of this invention to provide a method for forming a protective coating comprising one or more niobium aluminides on a niobium metal surface which comprises forming a slurry comprising a mixture of one or more flux agents and a metal coating material comprising aluminum or an aluminum base alloy capable of reacting with a niobium metal substrate at an elevated temperature to form a niobium aluminide based protective metal coating thereon, applying the mixture to the niobium metal surface, heating the coated metal surface sufficiently for the flux agent to clean the niobium metal surface, and then heating the coated niobium metal surface at a temperature sufficiently high to cause the aluminum or aluminum base alloy in the coating material to react with the niobium metal to form a protective coating of one or more niobium aluminides which is bonded to the niobium metal surface.

BRIEF DESCRIPTION OF THE DRAWING

The sole drawing is a flow sheet illustrating the process of the invention.

DETAILED DESCRIPTION OF THE INVENTION

The invention provides a method for forming a protective coating on a metal surface using a flux which is mixed with a metal coating material comprising one or more metals capable of reacting with one or more metals in the metal surface to form a reaction product and the mixture applied to the metal surface in a single step. The coated metal surface is then heated to a temperature sufficient to cause the flux to clean the coated metal surface, and then further heated to a temperature sufficiently high to cause the one or more metals in the metal coating material to react with one or more metals in the metal surface to form a protective reaction product in the form of a metal coating over the metal surface. Any flux remaining on the coated metal surface may then be removed, after cooling, by washing and by mechanical means such as scrubbing with a wire brush, if necessary.

By the expression "applied to the metal surface in a single step" is meant that the flux and the metal coating materials are both applied at the same time. It will be understood that this expression does not exclude the application of more than one layer of the coating mixture to the metal surface if desired.

The metal substrate or metal surface on which the protective metal coating will be formed in accordance with the invention may comprise any metal surface which, but for the formation of such a protective coating thereon, would be easily and significantly oxidized, i.e., a significant thickness of the metal surface would be lost to oxidation. By significant, is meant more than about 0.1 millimeters of the metal surface is lost when exposed to air for an hour at 1100° C. For example, a niobium surface without the formation of such a protective surface thereon, may lose up to 0.5 millimeters of metal surface thickness after exposure for 1 hour to an oxidizing atmosphere at 1100° C. This loss can increase to 0.8 millimeters at 1200° C. and 1.5 millimeters at 1300° C. for the same time period.

The invention may be practiced in connection with the formation of a protective metal coating over a ferrous metal surface, i.e., a surface consisting essentially of iron or a metal alloy having iron as its principal alloying constituent, as well as the related Group VIII metals cobalt and nickel and their alloys. However, the process of the invention is of particular importance in forming a protective coating over non-ferrous transition or refractory metals in Groups IVA, VA, VIA, and VIIA which will otherwise form oxide layers on the surface thereof. Such metals include Ti, V, Cr, Zr, Nb, Mo, Hf, Ta, W, Re and alloys which contain 50 wt. % or more of one of these metals.

The flux material or agent which, in accordance with the invention, will be mixed with the metal coating material prior to application of the coating to the metal surface to be protected, may comprise zinc fluoride, cadmium fluoride, one or more fluorides, fluoaluminates, or fluosilicates of an alkali metal, one or more fluorides, fluoaluminates, or fluosilicates of an alkaline earth metal, as well as mixtures of any of these flux materials. Such fluxes include $ZnF_2$, $CdF_2$, LiF, NaF, KF, RbF, CsF, $MgF_2$, $CaF_2$, $SrF_2$, $BaF_2$, $Na_3AlF_6$, $K_3AlF_6$, $Na_2SiF_6$, and $K_2SiF_6$, as well as materials which decompose or react upon heating to form such alkali metal or alkaline earth metal fluoride-containing flux compounds. The flux may also comprise a mixture of fluorides, with the balance comprising bromides, iodides, and/or chlorides, of any one or more of the above metals provided at least about 10 wt. %, preferably at least 50 wt. %, of the flux comprises one or more fluorides. It should be noted that beryllium fluoride is not included in the above list because of the high toxicity of beryllium which makes its use undesirable from an environmental standpoint. It will, therefore, be understood that references to alkaline earth metal fluorides is intended to exclude $BeF_2$.

Preferably the flux materials, when more than one of the above compounds is used, will be heated to form a homogeneous mixture which then, after cooling, may be ground or otherwise particulated to the desired particle size.

The metal coating material which is mixed with the flux agent or agents and then applied with the flux to the surface of the metal to be coated should comprise a metal, metal alloy, or a mixture of either two or more metals, two or more metal alloys, or a mixture of both one or more metals and one or more metal alloys.

At least one of the metals or metal alloys in the metal coating material must first of all be capable of chemically reacting with one or more metals, metal alloys, or mixture of same comprising the metal surface to form a protective coating which comprises the reaction product of one or more of the metals and/or metal alloys in the metal surface being coated and one or more of the metals, and/or metal alloys in the metal coating material applied over the metal surface.

Secondly, the metal coating material must be capable of forming a reaction product with the metal surface to be coated, which reaction product will comprise a protective intermetallic coating of one or more intermetallic compounds which are more resistant to oxidation than the metal surface being coated.

Thirdly, the metal coating material must comprise a metal, metals or metal alloy which will not chemically react with the materials in the flux to form reaction products which would interfere with the reaction between the one or more metals in the metal surface and the one or more metals in the metal coating material.

It should be noted that the reaction product is one or more intermetallic compounds, i.e., a compound of two or more metals having definite proportions, not merely alloys or mixtures of the metals respectively in the metal coating materials and the metal surface. For example, when a metal coating material containing aluminum is applied to a niobium metal surface and the coated surface is then heated, the aluminum and niobium react to form one or more niobium aluminides, principally $NbAl_3$, although thin layers of $Nb_2Al$ and $Nb_3Al$ have also been found to be present between the $NbAl_3$ and the niobium metal surface.

With respect to the above characteristics of the metal coating materials, it should be noted that the protective coating is not totally resistant to any oxidation. Rather, the particular elements used in the coating material control the type of oxide formation, as will be explained below, resulting in a more continuous oxide coating which, once formed, inhibits the passage of further oxygen therethrough and in itself, therefore, forms a protective oxide over the metallic reaction product coating on the metal surface.

Examples of metals which may be used singly or in combination in the metal coating material include aluminum, chromium, and alloys or mixtures of aluminum and chromium and alloys of same. At least about 50 wt. % of the metal coating material should comprise aluminum with the balance comprising chromium and one or more additives as discussed below. The use of chromium metal or alloy in the coating material has been found to be desirable because the presence of chromium oxide dissolved in aluminum oxide reduces oxygen diffusion through the aluminum oxide.

In addition to the aluminum and chromium metals, alloys, etc. in the metal coating material, one or more other elements may be present as an additive to the metal coating material. Such additives may each be present in the coating material in an individual amount of up to about 5 wt. %, preferably up to about 3 wt. %, of the total metal coating material weight, with the total amount of all of such additives not exceeding about 10 wt. % of the total weight of the metal coating material.

Such additives include boron, silicon, barium, strontium, calcium, hafnium, titanium, zirconium, yttrium, and any of the rare earth metals including scandium and lanthanum, but excluding promethium, e.g., including cerium, praseodymium, neodymium, samarium, europium, gadolinium, terbium, dysprosium, holmium, erbium, thulium, ytterbium, and lutetium.

Of these additives, boron, silicon, yttrium, and hafnium are particularly preferred additives to the metal coating material. It is believed that the presence of silicon and/or boron a additives in the coating material promotes the formation of the more continuous or coherent $Al_2O_3$, through which oxygen diffusion is rather slow, instead of the noncontinuous $NbAlO_4$ as a oxide coating over the final product.

The presence of yttrium as an additive in the metal coating material is believed to promote the diffusion of aluminum outward through the oxide instead of oxygen diffusing downward to reach the substrate under the protective coating layer. Yttrium is also believed to improve the adherence of the protective oxide scale to the underlying reaction product.

The use of hafnium as an additive in the metal coating material is of particular advantage with certain metal surfaces such as nickel or a nickel alloy to promote the adherence of the reaction product, e.g. nickel aluminide, to the underlying metal surface.

In a preferred embodiment, as stated above, the flux materials are first melted together to homogenize them and then cooled. The metal coating materials and flux materials are then ground separately or together or otherwise particulated to a particle size which may range from 0.1 microns to 500 microns, preferably 10 microns to 100 microns. The flux materials and the metal coating materials, if particulated separately, are then mixed together in particulate form.

The particulate mixture is applied to the surface of the metal to be coated either in dry form or, advantageously, as a slurry in a non-reactive liquid carrier which will facilitate temporary adherence of the mixture of flux and metal coating material to the metal surface to be protected. The slurry may be applied to the metal surface in any convenient manner, for example, by spraying, wiping, painting, or by dipping the metal surface into the slurry.

The carrier in which the particulate mixture may be slurried may comprise an aqueous liquid, e.g., water, or an organic liquid such as an alcohol, e.g., methanol, ethanol, n-propanol or isopropanol; an ether, e.g., methylethyl ether, diethyl ether, phenylmethyl ether, diethylene glycol dimethyl ether, or dioxane; an aldehyde, e.g., formaldehyde or acetaldehyde; or a ketone, e.g., acetone or methylethyl ketone; provided that the liquid is not chemically reactive with any of the other materials nor a solvent for the metal coating materials. The organic carriers will be preferred because of the ease of subsequent removal of the liquid by evaporation. A surfactant or wetting agent may be added to the slurry mixture, if desired, to promote wetting to the metal surface to which the slurry is applied.

In accordance with the invention, the particulate mixture of flux and metal coating material is applied to the metal surface to be protected and, if applied as a slurry with a carrier liquid, allowed to dry, either at room temperature or by heating the structure to a temperature of up to about 200° C. The thickness of the dried coating should be at least about 10 microns, preferably at least about 30 microns, but preferably no more than about 100 microns.

The coated metal surface is then heated up to the desired reaction temperature at a rate of from about 5° C. to about 50° C. per minute, and preferably about 25° C. per minute, to permit the flux to react with any oxides or other coatings on the metal surface which might interfere with the reaction between the metal coating materials and the metal or metals in the metal surface.

The reaction temperature to which the coated metal surface will be heated may vary from about 900° C. to about 1200° C., depending upon the particular metal coating materials and the particular metal or metals in the metal surface which will react with the metal coating materials. The coated metal surface will be held at this final reaction temperature for a period of from about 10 to about 90 minutes. Longer periods of time may be used but are unnecessary for the successful practice of the process of the invention.

Preferably, the reaction will be carried out in a non-oxidizing atmosphere such as an argon atmosphere (or possibly nitrogen if the reaction temperature is less than 1100° C.). A reducing atmosphere such as a hydrogen atmosphere may also be used in some instances, if desired or deemed necessary, provided, however, that none of the reactants, e.g., Ti, Zr, Hf, V, Nb, and Ta, will react with the hydrogen to form a hydride.

After formation of the protective coating on the metal surface, the coated metal surface is cooled and any remaining flux materials which may have floated to the surface of the coating may be removed by rinsing in water and, if necessary, by physically scrubbing the surface of the coating, for example, with a wire brush.

While we do not wish to be bound by any theory of operation of the method of the invention, it is believed that the success of the process of the invention may possibly be due, at least in part, to the melting of the flux and reaction between the flux and the metal surface to clean the surface at a temperature somewhat below the reaction temperature of the one or more metals, metal alloys, etc., in the metal coating materials with the one or more metals, metal alloys, etc., in the metal surface resulting in the cleaning or oxide removal on the surface of the metal or metals to be coated followed by reaction of the metal coating material with the newly exposed metal surface before the metal surface is again covered with oxide materials.

In view of this, in a particularly preferred embodiment of the invention, the flux materials will be chosen, with respect to the metal coating materials, to have a melting point lower than the reaction temperature between the one or more metals, metal alloys, etc., in the metal coating materials and the one or more metals, metal alloys, etc., in the metal surface by from about 20° to about 200° C.

Thus, in the preferred embodiment, the flux will comprise a mixture of flux agents to lower the melting point of the flux mixture, and most preferably to form a low melting point eutectic. Usually the flux mixture will comprise at least about 50 wt. % of an alkali metal fluoride since the alkali metal fluorides all have melting points below 1000° C. which is considerably lower than the melting points of the defined alkaline earth metal fluorides which have melting points varying from 1190° C. ($SrF_2$) to 1396° C. ($MgF_2$). Use of such flux mixtures will permit melting of the flux and reaction with the oxides and other undesirable surface coatings o the metal surface to be protected before reaction between the metal coating materials and the metal surface.

For example, when a coating mixture of 88 wt. % aluminum, 10 wt. % chromium, and 2 wt. % silicon is used, a flux mixture of about 50 wt. % NaF and 50 wt. % $CaF_2$ will form a low melting point of about 820° C. whereby the flux will melt and react with the oxides or other coatings already present on the metal surface to be protected prior to reaction between the metal coating materials and the newly exposed metal surface to be protected.

The following examples will serve to further illustrate the process of the invention.

EXAMPLE I

A particulate metal coating mixture was prepared consisting essentially of 88 wt. % of 99%+ purity aluminum, 10 wt. % of 99%+ purity chromium, and 2 wt. % silicon having an average particle size of about 30 microns. A particulate flux consisting essentially of a previously fused mixture of 50 wt. % sodium fluoride and 50 wt. % calcium fluoride, also having an average particle size of 30 microns, was blended together with the metal coating materials in a ratio of approximately 96 wt. % metal coating materials and 4 wt. % flux. 23 grams of the particulate mixture was then slurried in 80 milliliters of an organic carrier comprising 3% cellulose ether in a 50/50 mixture of ethanol and diethylene glycol dimethyl ether commercially available as a thinner under the trademark YK thinner from ZYP coatings, Inc. The resultant slurry was applied to the surface of several niobium samples and then allowed to dry for at least 10 minutes at a temperature of at least 40° C.

The niobium surfaces coated with the slurry of flux and coating materials were then heated to a temperature of 1100° C. in an argon atmosphere at a rate of 25° C. per minute. The coated niobium samples were held at this temperature for 90 minutes to form a protective coating of one or more intermetallic niobium aluminide compounds thereon having an average thickness of about 50 microns. The coated metal samples were then cooled and the flux which had floated to the surface was removed by washing in water and scrubbing with a wire brush.

The coated niobium surfaces were then respectively heated in air to temperature of about 1100° C., 1200° C., and 1300° C. and then held at these respective temperatures for about 60 minutes after which the surfaces were examined for the formation of oxides thereon by metallography to expose cross-sections which were then polished and examined under an optical microscope at magnifications of 500x and 1000x. No signs of any appreciable amount of oxidation of the underlying niobium metal surface were found on any of the coated niobium surfaces indicating that the protective coating of niobium aluminide reaction product formed on the niobium surfaces by reaction between the niobium metal an the aluminum metal in the coating provided an effective protective barrier against oxidation of the underlying niobium metal surfaces. Metallography did show that the outer approximately 10 microns of the coating had converted into an $Al_2O_3$ scale, whereas the inner 40 microns remained as unconverted niobium aluminide. In contrast, uncoated niobium surfaces exposed for the same period of time, respectively at 1100° C., 1200° C., and 1300° C., as controls were examined and found to have about 0.5, 0.8, and 1.5 millimeters of niobium thickness lost due to oxidation.

The samples heated to the various temperatures were also measured for weight gain before and after exposure to the air at elevated temperatures. An uncoated niobium surface was also exposed to air for 60 minutes at 1200° C. and measured for weight gain as a control. The results are shown in the table below.

TABLE I

| Coated Sample No. | Exposure Temperature For 60 Minutes | Weight Gain in mg/cm$^2$ |
|---|---|---|
| 1 | 1100° C. | 2.7 |
| 2 | 1200° C. | 3.4 |

TABLE I-continued

| Coated Sample No. | Exposure Temperature For 60 Minutes | Weight Gain in mg/cm$^2$ |
|---|---|---|
| 3 | 1300° C. | 5.4 |
| Uncoated Control | 1200° C. | 1000 |

Similar results may be achieved by coating ferrous, nickel, cobalt, titanium, vanadium, chromium, zirconium, molybdenum, hafnium, tantalum, tungsten, and rhenium surfaces with the above slurry of coating materials and fluxes.

EXAMPLE II

A particulate metal coating mixture was prepared consisting essentially of about 87.9 wt. % of 99%+ purity aluminum, about 8 wt. % 99%+ purity chromium, about 1 wt. % silicon, about 3 wt. % $Y_3Al_2$, and about 0.1 wt. % boron and having an average particle size of about 30 microns. The coating mixture was mixed with the same particulate flux of Example I and in the same weight proportions and then formed into a coating slurry and applied to the surfaces of niobium samples as in example I. The heating procedures of Example I were then followed to form niobium aluminide coatings on the niobium samples except that the samples were, in this case, held at the reaction temperature of 1100° C. for 60 minutes.

After cooling and removal of any flux remaining on the surface, the samples were heated to 1200° C. in air and generally held at this temperature for 100 hours except for times when the samples were cooled down, examined for signs of oxidation, and then brought back up to the 1200° C. holding temperature. At the end of this period, the samples were again examined and found to have no visual evidence of any oxidation of the underlying niobium substrate although a thin protective oxide scale had formed on the surface of the coating. When one of the samples was heated to 1300° C. in air and held at this temperature for about 1 hour, subsequent inspection noted several small spots of effluent oxide indicating the beginning of attack of the substrate through the coating.

EXAMPLE III

A particulate metal coating material may be prepared consisting essentially of about 87.9 wt. % aluminum, about 8 wt. % chromium, about 1 wt. % silicon, about 3 wt. % $Y_3Al_2$, and about 0.1 wt. % boron having an average particle size of about 30 microns. A particulate flux consisting essentially of a previously fused mixture of about 30 wt. % NaF and about 70 wt. % cryolite ($NaAlF_4$), also having an average particle size of 30 microns, may be blended together with the metal coating material in a ratio of approximately 96 wt. % metal coating materials and 4 wt. % flux. The particulate mixture may then be formed into a slurry as in Example I and applied as a coating to a tantalum surface and then allowed to dry for at least 10 minutes at a temperature of at least 40° C.

The coated tantalum surface may then be heated to a temperature of about 1050° C. in an argon atmosphere at a rate of about 25° C. per minute. The coated tantalum surface may be held at this temperature for at least about 120 minutes to form a coating of tantalum aluminide having an average thickness of about 50 microns.

The coated tantalum surface, upon subsequent heating in air to a temperature of about 1200° C. and held at this temperature for about 60 minutes, will be found to be substantially free of tantalum oxide formation indicative of the protection afforded to the underlying tantalum surface against oxidation.

EXAMPLE IV

A particulate metal coating material may be prepared consisting essentially of about 87.9 wt. % aluminum, about 8 wt. % chromium, about 1 wt. % silicon, about 3 wt. % $Y_3Al_2$, and about 0.1 wt. % boron having an average particle size of about 30 microns. A particulate flux consisting essentially of a previously fused mixture of about 50 wt. % NaCl, about 25 wt. % $CaF_2$, and about 25 wt. % NaF, also having an average particle size of 30 microns, may be blended together with the metal coating material in a ratio of approximately 96 wt. % metal coating materials and 4 wt. % flux. The particulate mixture may then be formed into a slurry as in Example I and applied as a coating to a tungsten surface and then allowed to dry for at least 10 minutes at a temperature of at least 40° C.

The coated tungsten surface may then be heated to a temperature of about 1200° C. in an argon atmosphere at a rate of about 25° C. per minute. The coated tungsten surface may be held at this temperature for at least about 15 minutes to form a coating of tungsten aluminide having an average thickness of about 50 microns. The coated tungsten surface, upon subsequent heating in air to a temperature of about 1200° C. and held at this temperature for about 60 minutes, will be found to be substantially free of tungsten oxide formation indicative of the protection afforded to the underlying tungsten surface against oxidation.

Thus, the process of the invention provides for the protection of a metal surface by the single step application thereto of a mixture of a flux and a metal coating material followed by heating of the coated metal surface to flux the surface and cause a chemical reaction between one or more metals in the metal surface and one or more metals in the metal coating material to form a reaction product which comprises a protective coating resistive to oxidation and which is bonded to the underlying metal surface.

While a specific embodiment of the method of the invention has been illustrated and described for carrying out the process of forming a protective coating on a metal surface, by application of the flux and metal coating material to the metal surface in a single step, in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A process for the protection of a metal surface of a substrate, said process comprising:
   (a) forming a particulate mixture of a flux and a metal coating material capable of chemically reacting with said metal surface to form an intermetallic reaction product wherein;
      (i) said metal coating material is selected from the group consisting of one or more metals, one or more metal alloys, or mixtures of said one or more metals and one or more metal alloys; and
      (ii) said metal surface is selected from the group consisting of one or more metals, one or more metal alloys, and mixtures of said one or more metals and one or more metal alloys;
   (b) applying said particulate mixture to said metal surface of said substrate to form a coating thereon; and
   (c) heating the coated metal surface at a rate of from about 5° C. to about 50° C. per minute, to permit said flux to react with said metal surface to clean it as said metal surface is heated, after cleaning further heating until a temperature of from about 900° C. to about 1200° C. is reached to cause said one or more metals and/or metal alloys in said metal coating materials to chemically react with said metal surface to form a protective coating thereon comprising an intermetallic reaction product.

2. The process of claim 1 wherein said flux comprises one or more compounds selected from the class consisting of $ZnF_2$, $CdF_2$, LiF, NaF, KF, RbF, CsF, $MgF_2$, $CaF_2$, $SrF_2$, $BaF_2$, $Na_3AlF_6$, $K_3AlF_6$, $Na_2SiF_6$, $K_2SiF_6$, materials which decompose or react upon heating to form such alkali metal or alkaline earth metal fluoride-containing compounds, mixtures of same, and mixtures of same with one or more corresponding chloride, bromide, and iodide salts wherein at least 10 wt. % of the mixture comprises one or more of said fluoride salts.

3. The process of claim 2 wherein said flux comprises one or more compounds selected from the class consisting of $ZnF_2$, $CdF_2$, LiF, NaF, KF, RbF, CsF, $MgF_2$, $CaF_2$, $SrF_2$, $BaF_2$, $Na_3AlF_6$, $K_3AlF_6$, mixtures of same, and mixtures of same with one or more corresponding chloride salts wherein at least 10 wt. % of the mixture comprises one or more of said fluoride salts.

4. The process of claim 3 wherein at least 50 wt. % of said flux mixture comprises one or more of said fluoride salts.

5. The process of claim 3 including the further step of heating said mixture of flux compounds to form a homogeneous mixture and then particularizing the fused flux mixture.

6. The process of claim 2 wherein said particulate mixture of flux and metal coating material has a particle size range of from about 0.1 to about 500 microns.

7. The process of claim 6 wherein said particulate mixture of flux and metal coating material has a particle size range of from about 10 to about 100 microns.

8. The process of claim 6 wherein said particulate mixture of flux and metal coating material is formed into a slurry which is applied to said metal surface to form a coating thereon.

9. The process of claim 8 wherein said slurry is formed by dispersing said particulate mixture in a liquid which is not a solvent for said metal coating material.

10. The process of claim 9 wherein said carrier is an aqueous liquid.

11. The process of claim 9 wherein said carrier is an organic liquid.

12. The process of claim 11 wherein said carrier is selected from the class consisting of an alcohol, an ether, an aldehyde, a ketone, and mixtures thereof.

13. The process of claim 8 wherein said said slurry mixture is applied to said metal surface as a coating having a thickness of from about 10 microns to not greater than about 100 microns.

14. The process of claim 13 wherein said coated metal surface is dried by heating to a temperature of not more than about 200° C. for a period of at least about 10 minutes.

15. The process of claim 1 wherein said one or more metals and/or metal alloys in said metal coating material is reacted with said one or more metals and/or metal alloys in said metal surface at said reaction temperature for a period of at least about 10 minutes to form a reaction product which is bonded to said metal surface.

16. The process of claim 2 wherein said step of forming said particulate mixture further comprises selecting a flux for said particulate mixture comprising one or more flux compounds or mixtures thereof having a melting point of from about 20° C. to about 200° C. lower than the reaction temperature between said metal coating materials and said metal surface whereby said flux will react with said metal surface to clean said surface at a temperature lower than the reaction temperature between said metal coating materials and said metal surface.

17. The process of claim 16 wherein said flux comprises at least 50 wt. % of a flux material having a melting point of about 1000° C. or lower.

18. The process of claim 16 wherein said flux mixture comprises a mixture having a melting point below said reaction temperature between said metal coating materials and said metal surface.

19. The process of claim 16 wherein said at least 50 wt. % of a flux material having a melting point of 1000° C. or lower is selected from the class consisting of one or more alkali metal fluorides, one or more alkali metal fluoaluminates, and mixtures thereof.

20. The process of claim 1 wherein said metal surface capable of reacting with said one or more metals and/or metal alloys in said metal coating material is selected from the class consisting of one or more metals, one or more metal alloys, and mixtures of said one or more metals and said one or more metal alloys.

21. The process of claim 1 wherein said metal surface comprises one or more metals selected from the class consisting of iron, nickel, cobalt, titanium, vanadium, chromium, zirconium, niobium, molybdenum, hafnium, tantalum, tungsten, rhenium, and metal alloys containing at least 50 wt. % of one or more of said metals.

22. The process of claim 1 wherein said metal surface consists essentially of niobium.

23. The process of claim 1 wherein said metal coating material comprises one or more metals selected from the class consisting of aluminum, chromium, and alloys containing at least 50 wt. % aluminum.

24. The process of claim 22 wherein said metal coating material further comprises up to 5 wt. %, by total wt. % of the metal coating material, of one or more elements selected from the class consisting of boron, silicon, barium, strontium, calcium, hafnium, titanium, zirconium, yttrium, scandium lanthanum, cerium, praseodymium, neodymium, samarium, europium, gadolinium, terbium, dysprosium, holmium, erbium, thulium, ytterbium, and lutetium.

25. The process of claim 1 wherein:

(a) said metal surface consists essentially of niobium; and (b) said metal coating material comprises:

(1) one or more metals selected from the class consisting of aluminum, chromium, and alloys containing at least 50 wt. % aluminum; and (2) 0 to 5 wt. %, by total wt. % of the metal coating material, of one or more elements selected from the class consisting of boron, silicon, barium, strontium, calcium, hafnium, titanium, zirconium, yttrium, scandium lanthanum, cerium, praseodymium, neodymium, samarium, europium, gadolinium, terbium, dysprosium, holmium, erbium, thulium, ytterbium, and lutetium.

26. A process for the protection of a metal surface which comprises:

(a) forming a particulate mixture of:

(i) a flux comprising one or more compounds selected from the class consisting of $ZnF_2$, $CdF_2$, LiF, NaF, KF, RbF, CsF, $MgF_2$, $CaF_2$, $SrF_2$, $BaF_2$, $Na_3AlF_6$, $K_3AlF_6$, mixtures of same, and mixtures of same with one or more corresponding chloride compounds wherein at least 50 wt. % of the mixture comprises one or more of said fluoride compounds; and (ii) a metal coating material comprising one or more metals capable of chemically reacting with said metal surface to form a reaction product and selected from the class consisting of aluminum, chromium, mixtures of same, and alloys containing at least 50 wt. % aluminum; and up to 5 wt. % each, by total wt. % of said metal coating material, of one or more additional elements selected from the class consisting of boron, silicon, barium, strontium, calcium, hafnium, titanium, zirconium, yttrium, scandium, lanthanum, cerium, praseodymium, neodymium, samarium, europium, gadolinium, terbium, dysprosium, holmium, erbium, thulium, ytterbium, and lutetium, the total wt. % of said additional elements not exceeding 10 wt. % of said metal coating material;

(b) applying said particulate mixture to a metal surface comprising one or more metals selected from the class consisting of iron, nickel, cobalt, titanium, vanadium, chromium, zirconium, niobium, molybdenum, hafnium, tantalum, tungsten, rhenium, and alloys containing at least 50 wt. % of one or more of said metals, to form a coating thereon;

(c) heating the coating metal surface at a rate of from about 5° C. to about 50° C. per minute to a temperature sufficiently high to cause said flux to clean said metal surface; and (d) further heating said coated metal surface to a temperature of from about 900° C. to about 1200° C. at which said one or more of said metals and/or metal alloys in said metal coating material will chemically react with said one or more metals in said metal surface to form a protective coating thereon comprising a metal reaction product bonded to said metal surface.

27. The process of claim 26 wherein said step of forming a particulate mixture further comprises melting said flux compounds to form a homogeneous mixture which is then particularized.

28. The process of claim 26 wherein said step of forming said particulate mixture further comprises selecting a flux for said particulate mixture comprising one or more of said flux compounds or mixtures thereof having a melting point of from about 20° C. to about 200° C. lower than the reaction temperature between said metal coating materials and metal surface whereby said flux will react with said metal surface to clean said surface at a temperature lower than the reaction temperature between said metal coating materials and said metal surface.

29. The process of claim 28 wherein said flux comprises at least 50 wt. % of one or more alkali metal fluorides, one or more alkali metal fluoaluminates, or mixtures thereof having a melting point of 1000° C. or lower.

30. A process for the protection of a metal surface which comprises:

(a) forming a particulate mixture of:

(i) a flux comprising one or more compounds selected from the class consisting of $ZnF_2$, $CdF_2$, LiF, NaF, KF, RbF, CsF, $MgF_2$, $CaF_2$, $SrF_2$, $BaF_2$, $Na_3AlF_6$, $K_3AlF_6$, mixtures of same, and mixtures of same with one or more corresponding chloride compounds wherein at least 50 wt. % of the mixture comprises one or more of said fluoride compounds; and (ii) a metal coating material comprising one or more metals capable of chemically reacting with said metal surface to form a reaction product and selected from the class consisting of aluminum, chromium, mixtures of same, and alloys containing at least 50 wt. % aluminum; and up to 5 wt. % each, by total wt. % of said metal coating material, of one or more additional elements selected from the class consisting of boron, silicon, barium, strontium, calcium, hafnium, titanium, zirconium, yttrium, scandium, lanthanum, cerium, praseodymium, neodymium, samarium, europium, gadolinium, terbium, dysprosium, holmium, erbium, thulium, ytterbium, and lutetium, the total wt. % of said additional elements not exceeding 10 wt. % of said metal coating material;

(b) applying said particulate mixture to a metal surface comprising one or more metals selected from the class consisting of iron, nickel, cobalt, titanium, vanadium, chromium, zirconium, niobium, molybdenum, hafnium, tantalum, tungsten, rhenium, and alloys containing at least 50 wt. % of one or more of said metals, to form a coating thereon;

(c) heating the coated metal surface at a rate of from about 5° C. to about 50° C. per minute up to a temperature of from about 900° C. to about 1200° C. to permit said flux to clean said metal surface as said metal is heated; and (d) maintaining said coated metal surface within said temperature range for a period of at least 10 minutes to cause said one or more of said metals and/or metal alloys in said metal coating material to chemically react with said one or more metals in said metal surface to form a protective coating thereon comprising a metal reaction product bonded to said metal surface.

31. A process for the protection of a metal surface which comprises:

(a) forming a particulate mixture of:

(i) a flux comprising one or more compounds selected from the class consisting of $ZnF_2$, $CdF_2$, LiF, NaF, KF, RbF, CsF, $MgF_2$, $CaF_2$, $SrF_2$, $BaF_2$, $Na_3AlF_6$, $K_3AlF_6$, mixtures of same, and mixtures of same with one or more corresponding chloride compounds wherein at least 50 wt. % of the mixture comprises one or more of said fluoride compounds; and (ii) a metal coating material comprising one or more metals capable of chemically reacting with said metal surface to form a reaction product and selected from the class consisting of aluminum, chromium, mixtures of same, and alloys containing at least 50 wt. % aluminum; and up to 5 wt. % each, by total wt. % of said metal coating material, of one or more additional elements selected from the class consisting of boron, silicon, barium, strontium, calcium, hafnium, titanium, zirconium, yttrium, scandium, lanthanum, cerium, praseodymium, neodymium, samarium, europium, gadolinium, terbium, dysprosium, holmium, erbium, thulium, ytterbium, and lutetium, the total wt. % of said additional elements not exceeding 10 wt. % of said metal coating material;

(b) applying said particulate mixture to a metal surface comprising one or more metals selected from the class consisting of iron, nickel, cobalt, titanium, vanadium, chromium, zirconium, niobium, molybdenum, hafnium, tantalum, tungsten, rhenium, and alloys containing at least 50 wt. % of one or more of said metals, to form a coating thereon;

(c) drying the coating on said metal surface at a temperature of not more than 200° C. for a period of at least about 10 minutes;

(d) then heating the coated metal surface at a rate of from about 5° C. to about 50° C. per minute up to a temperature of from about 900° C. to about 1200° C. to permit said flux to clean said metal surface as said metal is heated; and (e) then maintaining said coated metal surface within said temperature range for a period of at least 10 minutes to cause said one or more of said metals and/or metal alloys in said metal coating material to chemically react with said one or more metals in said metal surface to form a protective coating thereon comprising a metal reaction product bonded to said metal surface.

* * * * *